United States Patent [19]

Brooks

[11] Patent Number: 4,994,178

[45] Date of Patent: Feb. 19, 1991

[54] HEAVIER-THAN-WATER POOL CLEANING DEVICE

[75] Inventor: David A. Brooks, Roodepoort, South Africa

[73] Assignee: Oakleigh Limited, Guernsey, Channel Islands

[21] Appl. No.: 314,410

[22] Filed: Feb. 22, 1989

[30] Foreign Application Priority Data

Feb. 18, 1988 [ZA] South Africa ..... 88/1142

[51] Int. Cl.[5] ..... B01D 21/04

[52] U.S. Cl. ..... 210/169; 210/241; 210/416.2; 403/76; 15/1.7; 405/74

[58] Field of Search ..... 210/169, 241, 525, 416.2; 15/1.7; 134/167 R; 4/490; 403/76, 122, 165; 405/74

[56] References Cited

U.S. PATENT DOCUMENTS

| | | | |
|---|---|---|---|
| 2,658,625 | 11/1953 | Rafferty | 210/499 |
| 3,063,077 | 11/1962 | Pansini | 210/169 |
| 3,825,356 | 7/1974 | Crook | 403/122 |
| 3,863,237 | 1/1975 | Doerr | 210/169 |
| 3,921,654 | 11/1975 | Pansini | 134/167 R |
| 4,040,864 | 8/1977 | Steeves | 15/1.7 |
| 4,518,495 | 5/1985 | Harding | 210/242.1 |
| 4,749,478 | 6/1988 | Brooks | 15/1.7 |
| 4,778,599 | 10/1988 | Brooks | 15/1.7 |

*Primary Examiner*—Richard V. Fisher
*Assistant Examiner*—Wanda L. Millard

[57] ABSTRACT

A device for cleaning a swimming pool has a pair of spaced parallel and aligned wings connected at their ends by bridge members to define a mouth, a bag fast with the wings at their trailing edges, a hinged draw-bar centrally connected to the front sides of the bridge members, triangular fins extending from outer surfaces of the wings, and a connecting component for connection to a hose which supplied water under pressure, the connecting component being connected to the draw bar by a ball-and-socket joint and having two jets angled towards the draw-bar. The device is heavier than water and is such that when it sinks in water the wings pivot about the hinge of the draw bar so that their trailing edges are above their leading edges.

21 Claims, 4 Drawing Sheets

HEAVIER-THAN-WATER POOL CLEANING DEVICE

THIS INVENTION relates to a device for cleaning a swimming pool.

According to the invention there is provided a device for cleaning a swimming pool which includes

- a pair of spaced wing-like members which have leading and trailing edges and which define a mouth-like opening at leading edges thereof;
- a foraminous bag secured to the wing-like members; and
- a draw element which is hingedly attached to the wing-like members for the wing-like members to be pivotal relative to the draw element, about a hinge axis,
- with the device having a specific gravity greater than unity and a centre of gravity and a centre of drag which are located so that a net couple is exerted on the wing-like members when the device falls freely in the water which tends to position the trailing edge of each member above the leading edge of that member.

It will be appreciated that the "centre of drag", is the point through which a resultant force passes equivalent to the drag force that the device experiences as it drops freely in water under the action of gravity, with the wing-like members extending and oriented generally horizontally.

The wing-like members may be parallel. They may further be the same length and may be aligned so that the opening is substantially rectangular. Bridging webs may extend between the ends of the wing-like members, to support the wing-like members in their spaced configuration and to define the mouth-like opening. Further bridging webs may be provided intermediate the ends of the wing-like members.

The draw element may be secured to the bridging webs at leading ends thereof. Preferably, the draw element is centrally secured to the bridging webs so that the structure defined by the wing-like members and the bridging webs is symmetrical about a median plane located midway between and parallel to the wing-like members.

Further, in a preferred embodiment, the hinge axis is close to the leading edges of the wing-like members.

The centre of gravity may be caused to be closer to the hinge axis by appropriate shaping of the wing-like and other members. Alternatively, or in addition, mass members may be provided which are secured either to the wing-like members and/or the bridge members and/or the draw element, to ensure that the centre of gravity is in the desired position.

Hinging may be provided by specific hinge members, or by means of hinge regions which have a reduced thickness.

Fins may be provided which are carried by the wing-like members on their opposed outer surfaces. Fins may also be carried by the outer bridging webs on their outer sides.

The draw element may be forked having prongs extending from a leading bar. The draw element may be attached to a displacing component. Conveniently, the displacing component may be hollow, may be connectable to a hose through which water under pressure is supplied and may have one or more jet nozzles which are directed towards the draw element such that water issuing therefrom causes the component and the draw element to be displaced. Preferably, the draw element is pivotally attached to the displacing component, by means of a ball-and-socket joint.

The wing-like members may be such that, when the device is drawn through the water, with the wing-like members tilted as a result of the net couple exerted by the drag force referred to above, they experience a downwardly directed hydro-dynamic force that tends to assist the weight of the device to cause the device to move downwardly in the water. The Applicant believes that, preferably, the centre of lift should be closer to the hinge axis than the centre of drag.

The invention is now described, by way of an example, with reference to the accompanying drawings, in which.

Figure 1:
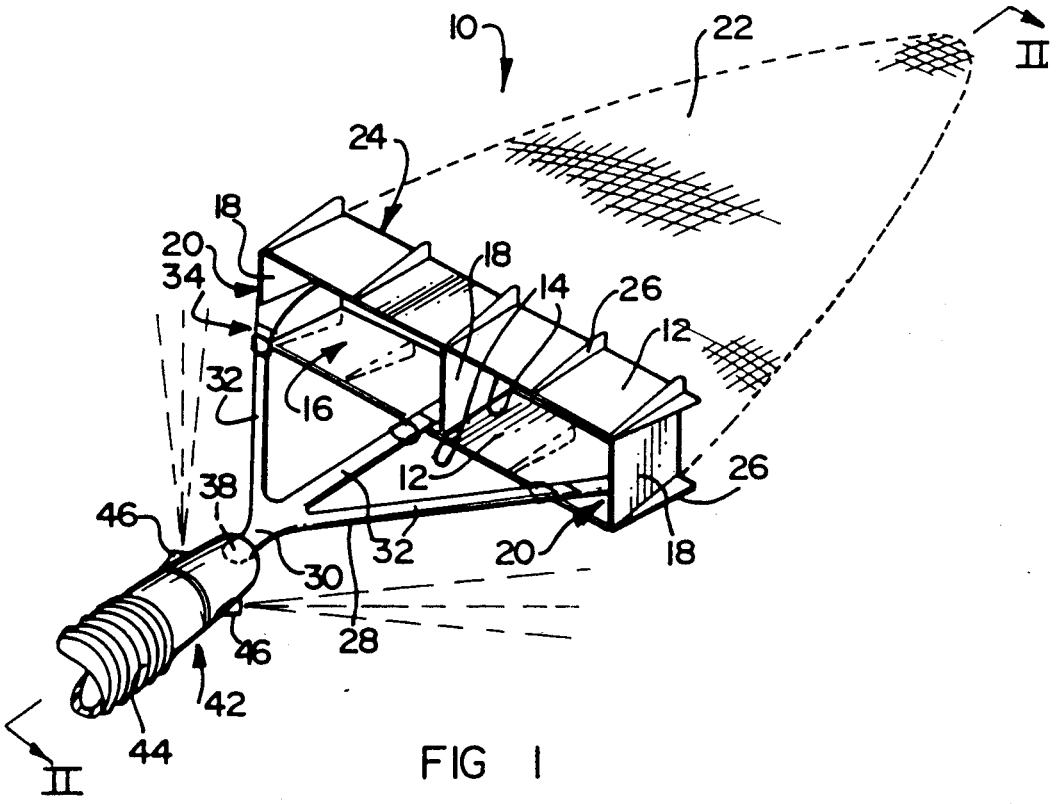
FIG. 1 shows a three dimensional view of a first embodiment of a device for cleaning a swimming pool, in accordance with the invention.
Figure 2:
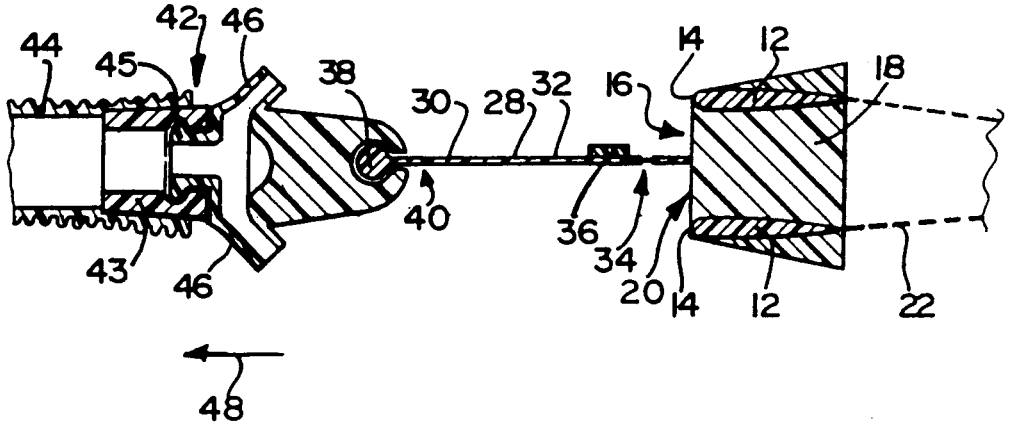
FIG. 2 shows a sectioned view of the device along line II-II in FIG. 1.

Referring to FIGS. 1 and 2, the device is designated generally by reference numeral 10. The device 10 has two wings 12 which are parallel and spaced apart such that leading edges 14 thereof partly define an opening 16. As is clearly seen in FIG. 2, the wings 12 have an aerofoil profile.

The wings 12 are held apart by bridge members 18. There are three bridge members 18, one at either end of the wings and the third midway between the ends of the wings 12. The opening 16 is further defined by leading edges 20 of the end bridge members 18.

A foraminous bag 22 is secured to the trailing edges 24 of the wings 12 and end bridge members 18. It will be appreciated that, in use, as described below, debris in the water passes through the opening 16 as the device 10 moves through the water, to be collected in the bag 22.

A number of fins 26 are secured to the outer surfaces of the wings 12 and the end bridge members 18. These fins 26 are substantially triangular with their trailing ends being wider.

The device 10 further has a draw element 28. The draw element 28 is forked having a leading bar 30 and three prongs 32. The prongs 32 are centrally attached to the leading edges of the bridge members 18 so that the device 10 is substantially symmetrical about a median plane that passes through the middle of the bridge members 18. Close to their free ends, the prongs 32 have hinge regions 34 which are of a reduced thickness to provide a hinge function. These hinge regions 34 are aligned to define a hinge axis that extends parallel to the leading edges 14 of the wings 12 and midway between them. Lead weights 36 are secured to the prongs 32 close to their hinge regions 34. The purpose of these weights 36 will be explained below.

The bar 30 has, at its leading end a ball 38 which is received in a socket 40 in the trailing end of a displacing component 42. The ball 38 and socket 40 define a ball-and-socket joint so that the bar 30 may pivot in two degrees of freedom relative to the component 42 and also swivel. As seen in FIG. 2, the component 42 is hollow and is engageable at its leading end with a flexible hose 44 through which, in use, water is supplied under pressure. The component 42 further has two jet nozzles 46 which are directed in a downstream direction so that in use a draw force in the direction of arrow 48 is exerted on the component 42 and which is transfered to the draw element 28. Further, the component 42 is in two parts 43 and 45 which are rotatably connected, the part 43 having an internal groove and the part 45 having a complementary circumferential projection.

Figure 3:
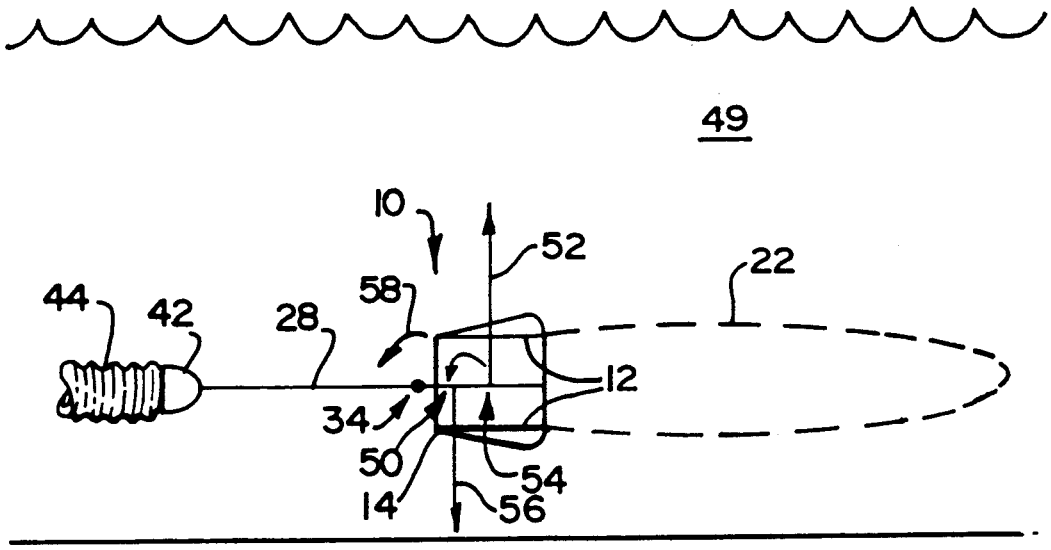
FIGS. 3 to 6 shows schematically how the device operates.

The operation of the device 10 is now explained with reference to FIGS. 3 to 6. Reference is initially made to FIG. 3 which shows schematically the forces experienced by the device 10 when it is at rest, ie. not being drawn through water 49 in the pool. It will be appreciated that the device 10 has a specific gravity that is greater than unity so that it sinks in the water 49. The device 10 has centre of gravity 50 which passes through the wings 12 close to the leading edges 14 thereof. If the wings 12 extend horizontally from front-to-back and side-to-side as shown schematically in FIG. 3, and the device 10 is allowed to fall through the water 49 under the action of gravity, the various parts of the device 10 will experience drag forces which have a resultant 52 that passes through a centre of drag 54. As shown in FIG. 3, the centre of drag 54 also passes through the wings 12, with the centre of gravity between it and the hinge axis 34. Further, the device 10 is designed such that the weights 56, the distance of the centre of gravity 50 from the hinge region 34, the drag force 52 and the distance of the centre of drag 54 from the hinge region 34 exerts a net couple on the wings 12 about the hinge axis 34 that is anti-clockwise when seen in FIG. 3, as shown by the arrow 58. Thus, if the device 10 were to sink through the water, the wings 12 would tilt so that their leading edges 14 are below their trailing edges 24. It will be appreciated that the weights 38 ensure that the centre of gravity 50 is in the desired position.

Figure 4:
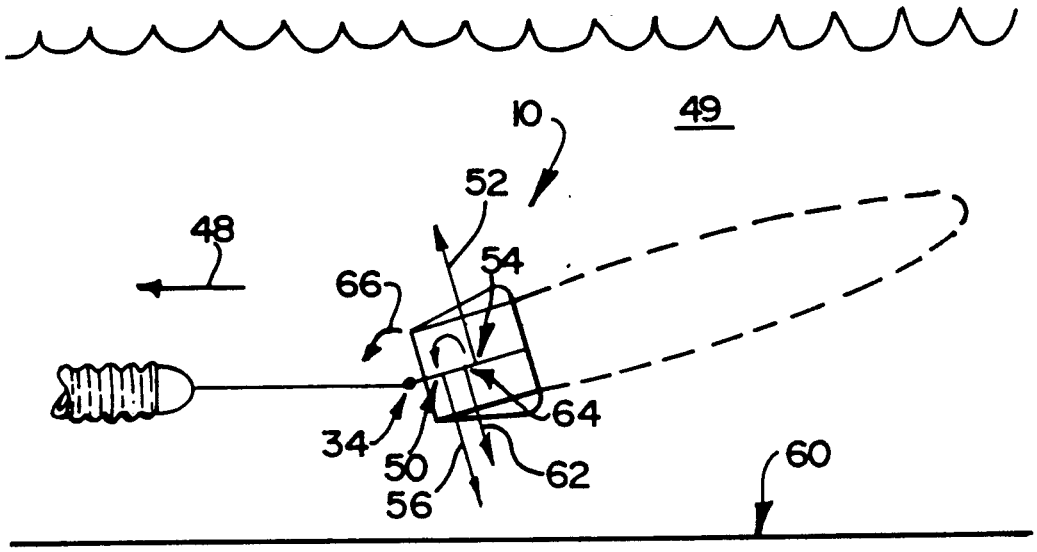

Referring now to FIG. 4, the operation of the device 10 as it moves through the water 49 in the direction of arrow 48 is shown. As the device moves through the body of water 49, ie. not in contact with a floor 60 of the pool, the device 10 will experience a drag force 52 substantially as it does when at rest and a gravitational force 56 which tilt the wings 12 as described above. In addition, the wings 12 have a suitable profile so that a hydro-dynamic force 62 is exerted on the wings 12 which is downwardly directed when the wings 12 are tilted as described, ie. with their trailing edges above their leading edges. This negative-lift force 62 acts through a centre of lift 64 and assists the weights 56 in displacing the device 10 downwardly towards the floor 60.

It will be appreciated that the hydro-dynamic negative lift force 62 will depend on the angle of attack of the wings 12 and the speed with which the device moves through the water. Such devices are usually operated at speeds of between about 0,5 feet/sec and 5 feet/sec, i.e. between about 0,15 m/sec and 1.5 m/sec. This force will cause the angle of attack of the wings 12 to decrease in comparison with the angle when falling freely, and the faster the device moves, the closer the wings will pivot towards a zero angle of attack. However, as the angle of attack decreases the magnitude of the force 62 decreases, and the Applicant accordingly believes that the device will move down in the water, towards the floor 60 of the pool, with the leading edges 14 of the wings 12 below their trailing edges.

Figure 5:
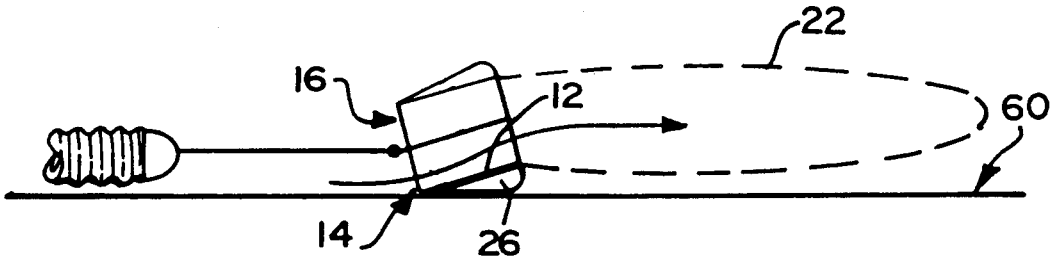

The reason for this is to try and provide that the leading edge 14 of the lowermost wing 12 engages the floor 60 as is shown in FIG. 5 so that any dirt or debris on the floor 60 is displaced into the opening 16 and into the bag 22. It will be appreciated that the triangular shape of the fins 26 assist in maintaining the wings 12 in the tilted attitude that is desired as the device moves along and in contact with the floor 60.

Figure 6:
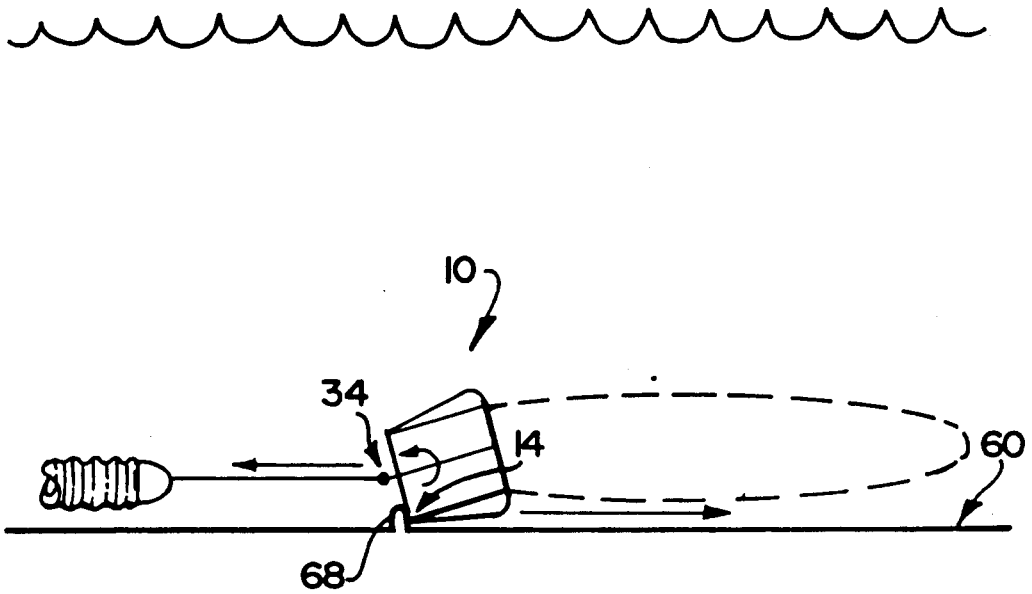

If the device 10 should meet a projection 68 on the floor 60 as is shown in FIG. 6, because the hinge axis 34 is in front and above the leading edge 14 of the lowermost wing 12, the wings 12 will pivot about the hinge axis 34 to assist the device 10 in passing over the protrusion 68. The forces on the device 10 will thereafter ensure that the device 10 returns to the floor 60 with the desired orientation.

Figure 7:
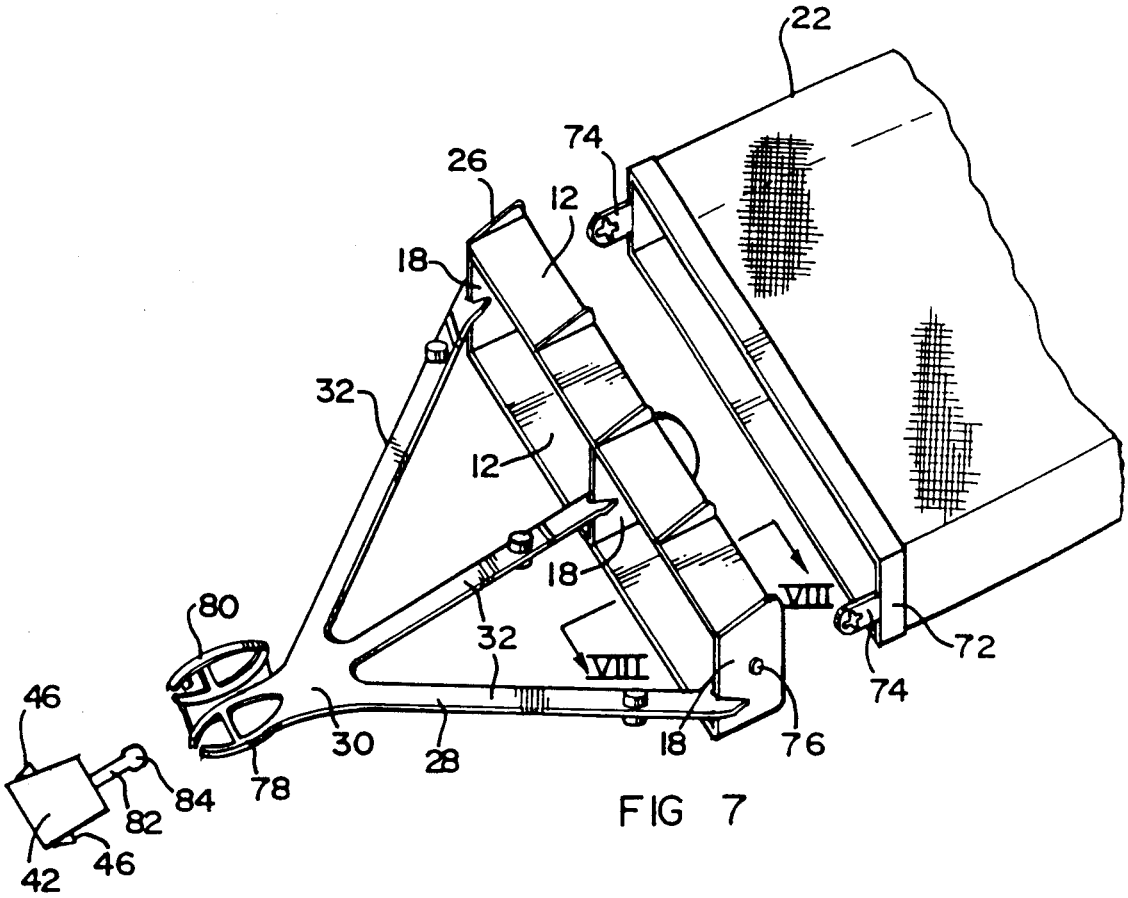
FIG. 7 shows a three-dimensional view of part of a further embodiment of a device in accordance with the invention.
Figure 8:
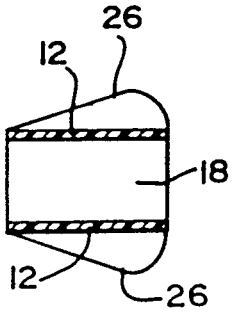
FIG. 8 shows a sectioned view of a part of the device in FIG. 7, along line VIII—VIII therein.

Referring further to FIGS. 7 and 8, a further embodiment of a device in accordance with the invention is shown. This embodiment is similar to that shown in FIGS. 1 and 2 and is similarly referenced. However, with this embodiment, the wings 12 are flat as is clearly seen in FIG. 8, the bag 22 is fast with a frame 72 that has lugs 74 which clip onto pins 76, and the component 42 has a pin 82 with a head 84 that is held in a socket arrangement formed by two parts 78 and 80 at the free end of the bar 30. The parts 78 and 80 clip together.

By means of the invention a simple and inexpensive device is provided for the cleaning of swimming pool floors.

I claim:

1. A heavier-than-water cleaning device for connection to a flexible hose to be drawn in submerged condition through the water in a swimming pool, said cleaning device comprising:

a draw element having a leading end for connection to the flexible hose and a relatively wide trailing end;

a wing assembly including a pair of elongated, wing-like members, bridge members supporting the wing-like members in spaced, generally parallel condition, said wing-like members having leading edges adjacent said trailing end of said draw element, and means for securing a debris collecting bag with an open mouth to said wing-like members with the mouth opening forwardly between said wing-like members to collect debris;

hinge means connecting said trailing end of said draw element to said wing assembly adjacent said leading edges to permit downward tilting of the leading edges of the wing-like members relative to the draw element and the bag;

said wing assembly and said draw member having a center of gravity that is positioned closer to said leading edges than to the trailing edges of said wing-like members to cause the wing assembly to tilt said leading edges downwardly when sinking in the water, whereby the assembly will automatically assume an inclined condition and also will develop a downward hydrodynamic force when the device is drawn through the water;

and longitudinally spaced triangular fins projecting outwardly from each of said wing-like members on opposite sides of the wing assembly and forming skids for engaging the floor of the pool, said fins having outer edges that are inclined away from the wing-like elements from the leading edges toward the trailing edges thereof to maintain the inclined condition of the wing assembly while the fins are in engagement with the floor of the pool.

2. A cleaning device as defined by claim 1 wherein said draw element is forked, and has prongs that are connected by said hinge means to said wing assembly at points spaced apart longitudinally across the wing assembly.

3. A cleaning device as defined by claim 2 wherein said bring members connect said wing-like members and hold them in spaced relation at least adjacent the ends of the wing assembly, said prongs being connected to said bridge members between said wings.

4. A cleaning device as defined by claim 3 further including weights on said prongs adjacent said hinge means for increasing the rate at which the prongs sink, thereby to tilt the leading edges of said wing-like elements downwardly.

5. A cleaning device as defined by claim 4 wherein said weights are on said prongs across said hinge means from the wing assembly.

6. A cleaning device as defined by claim 3 wherein a third bridge member centrally connects said wing members, said draw member having a prong extending to each bridge member.

7. A cleaning device as defined by claim 3 wherein said hinge means comprise flexible regions of said prongs adjacent said wing assembly that are aligned to produce the hinge.

8. A cleaning device as defined by claim 2 wherein said draw element has rotatable connecting means adjacent its leading end for connecting the device to the flexible hose.

9. A cleaning device as defined by claim 8 further including at least one jet nozzle on said draw element directed toward said wing assembly to receive a fluid flow through the flexible hose thereby to deflect debris into the collecting bag and to create a force for drawing the cleaning device through the water.

10. A cleaning device as defined by claim 1 wherein the wing assembly, including the triangular fins, are symmetrical about a median plane midway between and parallel to said wing-like members, said draw element being connected to said bridge members at said plane, and said draw element having a rotatable connection at its leading end for connection to the flexible hose.

11. A cleaning device as defined by claim 10 further including at least one jet nozzle on said draw element directed toward said wing assembly to receive a fluid flow through the flexible hose thereby to deflect debris into the collecting bag and to create a force for drawing the cleaning device through the water.

12. A cleaning device as defined by claim 1 wherein said wing-like members have airfoil profiles.

13. A cleaning device as defined by claim 1 wherein said wing-like members are flat.

14. A cleaning device as defined by claim 1 wherein said triangular fins have narrow ends at the leading ends of said wing-like members, and wider ends at the trailing ends thereof.

15. A cleaning device as defined by claim 1 wherein said wing assembly forms a box-like structure with open leading and trailing sides and ends closed by said bridge members, said bag connecting means comprising a frame attachable to and surrounding the mouth of a bag, and clip means on said wing assembly for releasably connecting said frame to the assembly.

16. A heavier-than-water cleaning device to be drawn in submerged condition through water in a swimming pool, said cleaning device comprising:

a draw element having a leading end and a trailing end;

a wing assembly including at least one elongated wing having a leading edge adjacent said trailing end, and means for securing a collection bag having an open mouth to said wing assembly and holding said mouth open with said wing extending across one side of the open mouth;

hinge means connecting said trailing end of said draw element to said wing assembly adjacent said leading edge, and permitting downward tilting of the leading edge of the wing relative to the draw element and the bag;

said wing assembly having a center of gravity that is positioned closer to said leading edge than to the trailing edge of said wing to cause the wing assembly to tilt said leading edge downwardly when sinking in the water, whereby the assembly will automatically assume an inclined condition and also will develop a downward hydrodynamic force when the device is drawn through the water;

and skid means on said wing inclined away from the wing for engaging the floor of the pool and maintaining the wing in the inclined condition as it slides along the floor.

17. A heavier-than-water cleaning device as defined in claim 16 wherein said wing assembly comprises two elongated wings, means supporting said wings in spaced generally parallel relation including bridge members extending between the wings, and in which said skid means comprises triangular fins on opposite sides of said assembly with narrow ends of said fins adjacent the leading edges of the wings and wide ends adjacent the trailing edges of the wings.

18. A heavier-than-water cleaning device as defined in claim 17 wherein said draw element is connected to said bridge members at a median plane between and parallel to said wings, and includes means at its leading end for rotatably connecting the draw member to a propelling device.

19. A heavier-than-water cleaning device as defined in claim 16 wherein said draw element is forked and has prongs extending rearwardly in a plane parallel to said wings and connected to said bridge members centrally between said wings, said hinge means comprising flexible sections of said prongs adjacent said wing assembly.

20. A heavier-than-water cleaning device as defined in claim 19 further including weights attached to said prongs adjacent said hinge means to cause the leading edges of said wing assembly to tilt downwardly when sinking in water.

21. A heavier-than-water cleaning device as defined in claim 16 wherein said hinge means are part of the draw element and comprise flexible sections permitting said downward tilting of the wing assembly.

* * * * *